US006202614B1

(12) United States Patent
Grob et al.

(10) Patent No.: US 6,202,614 B1
(45) Date of Patent: Mar. 20, 2001

(54) DRIVE MECHANISM FOR A MOTOR VEHICLE

(75) Inventors: Ferdinand Grob, Besigheim; Gerhard Koelle, Wiernsheim; Peter Ahner, Boeblingen; Klaus Harms, Vaihingen; Manfred Ackermann, Oppenweiler, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/297,455

(22) PCT Filed: Aug. 17, 1998

(86) PCT No.: PCT/DE98/02390

§ 371 Date: May 1, 1999

§ 102(e) Date: May 1, 1999

(87) PCT Pub. No.: WO99/15787

PCT Pub. Date: Apr. 1, 1999

(30) Foreign Application Priority Data

Sep. 19, 1997 (DE) ..... 197 41 294

(51) Int. Cl.[7] ..... F02N 11/06

(52) U.S. Cl. ..... 123/179.3; 290/35

(58) Field of Search ..... 123/179.3, 179.5, 123/179.28, 179.1; 290/35

(56) References Cited

U.S. PATENT DOCUMENTS 5,323,743 * 6/1994 Kristiansson ..... 123/179.3
5,687,682 * 11/1997 Rembold et al. ..... 123/179.3

* cited by examiner

*Primary Examiner*—Andrew M. Dolinar
(74) *Attorney, Agent, or Firm*—Michael J. Striker

(57) ABSTRACT

The invention relates to a drive assembly of a motor vehicle, having a internal combustion engine and an electrical machine coupled or capable of being coupled to a crankshaft of the engine, wherein the electrical machine can be switched to motor and generator modes, and having an electronic control unit for controlling direct injection and ignition of the engine. It is provided that at the start of the engine (12) the crankshaft (16) can be put in a predeterminable starting position via the electrical machine (22) switched for motor operation, and upon attaining the starting position of the crankshaft (16), the ignition of the fuel injected into a starting cylinder (14) is effected, and via the electrical machine (22), a torque can be exerted on the crankshaft (16) during the entire starting operation.

8 Claims, 1 Drawing Sheet

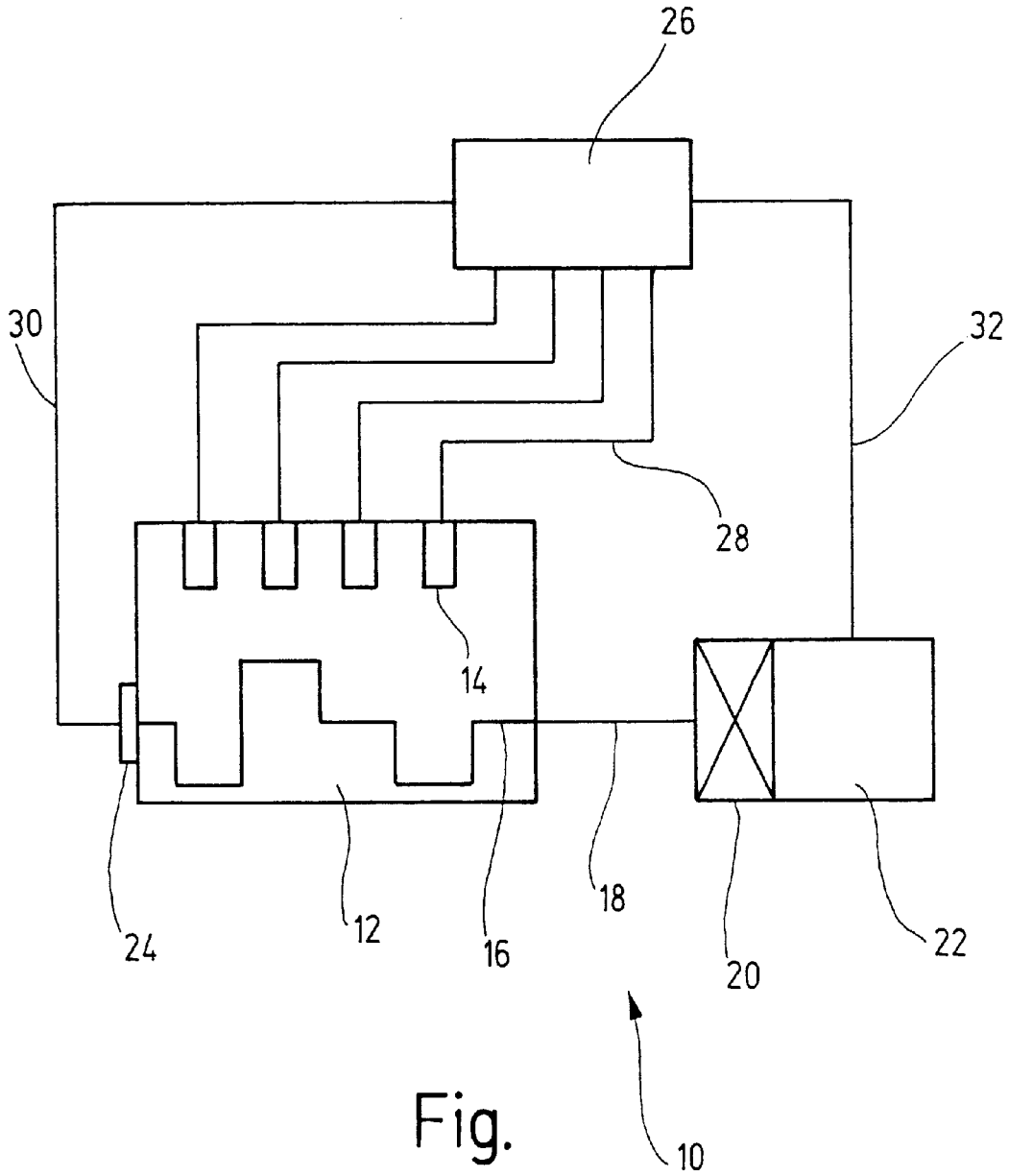
Fig.

DRIVE MECHANISM FOR A MOTOR VEHICLE

BACKGROUND OF THE INVENTION

The invention relates to a drive assembly of a motor vehicle having an internal combustion engine.

It is known to drive motor vehicles via internal combustion engines (hereinafter simply engines). These engines must be rotated up to speed for starting, until the engine begins to run on its own as a consequence of incipient combustion moments. To crank the engine, i.e., to turn it over, it is known to run the engine up to speed with an electric starter, whose pinion meshes with a toothed ring disposed on an engine crankshaft in a manner fixed against relative rotation and starts to turn it. This cranking device has stood the test of time but has the disadvantage of being noisy; also, because of parts subject to mechanical wear, the engine can be started with it only a limited number of times.

By realizing novel vehicle concepts which seek in particular to reduce fuel consumption, engines must be subjected to a high number of starting cycles. To save fuel, engines are turned off when the vehicle is stopped, for instance at a traffic light, in the so-called start-stop engine operating mode, and then automatically cranked again and started when the vehicle is to be driven onward again.

It is known to use electrical machines that are operated in the motor mode and the generator mode and are connected in force-locking fashion to a crankshaft of the engine. In the motor mode, direct starting of the engine can be done; after the engine runs up to speed, the electrical machine is switched over to a generator mode and serves to furnish a supply voltage for the motor vehicle. A disadvantage here is that particularly in cold starting, the electrical machine must be excessively oversized if it is to bring the requisite starting power to bear.

A so-called internal direct start is also known, in which the crankshaft, via a positioning device, is brought into a defined position so that the piston of a starting cylinder—a particular defined piston from among the total number of pistons of the engine—is brought into a starting position, stays there, and then by injection and ignition of fuel, a first combustion moment is generated, which is utilized to crank the engine. A disadvantage here is that because of the prepositioning time, only relatively poor starting dynamics are attainable, so that the engine does not begin to run on its own until after a relatively long time.

SUMMARY OF THE INVENTION

It is an object of the present invention to eliminate the disadvantages of the prior art.

In keeping with these objects, one feature of present invention resides, briefly stated, in that in the drive assembly of a motor vehicle the cylinder is the starting cylinder, whose piston can be brought into the starting position over the shortest path (angular rotation of the crankshaft), and a torque can be exerted on the crankshaft during the entire starting operation.

The drive assembly of a motor vehicle according to the invention offers the advantage over the prior art that an internal combustion engine can be made to run on its own quickly, in a simple way. Because when the engine is started the crankshaft can be brought into a predeterminable starting position via an electrical machine connected in the motor mode and coupled in force-locking fashion to a crankshaft of the engine, the direct injection and ignition of the fuel are effected when the crankshaft starting position is reached, and via the electrical machine, a torque can be exerted on the crankshaft during the entire starting operation, it is advantageously possible via a coordinated control of the rotational angle, rotary speed and injection of the engine and the superposition of the torque generated electrically via the electrical machine with combustion moment generated as a consequence of a first ignition of the engine, to attain a continuously accelerated runup of the engine to operating speed, so that the engine changes over seamlessly and automatically to running on its own. In particular because of the imposition of the torque via the electrical machine, the rpm of the crankshaft of the engine, during the first direct injection of fuel and its ensuing ignition, is other than zero, so that via the combustion moment brought to bear, by the first ignition of the engine, a markedly higher torque is developed at the start, compared with a start with a crankshaft at a standstill. This combustion moment is supported by the electrical machine that is still in the motor mode, so that the crankshaft is quickly accelerated, and the engine begins to run on its own no later than from the second injection and ignition on. As a result, a highly dynamic start and highly dynamic runup of the engine to speed are attained. Within a short time, the shortness of which is needed especially in a start-stop engine operating mode, the engine can be brought up to speed or to running on its own for a high number of starting cycles, which can be on the order of several hundred thousand starting cycles, for instance.

In a preferred embodiment of the invention, to initiate the starting operation, the current position of the crankshaft can be ascertained, and independently of the direction of rotation the crankshaft is brought into the starting position over the shortest path from the current crankshaft position and then—from the instant of ignition on—is rotated onward in the correct rotational direction. As a result, it becomes advantageously possible, optionally by reverse rotation of the crankshaft as well, for the starting position of the crankshaft to be attained over the shortest path and thus within the shortest possible time. The advantage is also obtained that particularly upon reverse rotation of the crankshaft, a compression occurs in the starting cylinder that leads to an increase in the combustion moment of the first combustion, without the need to pass through top dead center in the usual way, so that the starting dynamics or runup dynamics of the engine are further improved.

Further advantageous features of the invention will become apparent from the other characteristics recited in the dependent claims.

BRIEF DESCRIPTION OF THE DRAWING

The invention is described in further detail below in an exemplary embodiment in conjunction with the associated drawing, which schematically shows a drive assembly of a motor vehicle.

DESCRIPTION OF THE PREFERRED EMBODIMENT

In the drawing, an arrangement of a drive assembly 10 of a motor vehicle is schematically shown. The drive assembly 10 includes an internal combustion engine 12, which has for instance four cylinders 14. The cylinders 14 are assigned a crankshaft 16, which in a known manner converts the motion of pistons, disposed in the cylinders 14, into a rotary motion of a driven shaft 18. The driven shaft 18 is coupled force-lockingly to an electrical machine 22 via a gear 20.

The drive assembly 10 also includes a main gear, not shown, by way of which a rotary motion of the driven shaft 18 can be transmitted to the driven wheels of the motor vehicle. The gear 20 shown here is optionally a component of the main gear, not shown.

The crankshaft 16 is assigned a rotary angle sensor, by which of which the position of the crankshaft 16 can be ascertained. A prior coding takes place in the process, so that the rotary angle of zero degrees, for instance, stands for a defined position of the crankshaft 16. The cylinders 15 have direct injection and ignition, not shown in detail, which are triggerable via a control unit 26. To that end, the connecting lines 28 suggested here are provided between the control unit 26 and the injection and ignition. The control unit 26 is also connected to the rotary angle sensor 24 via the connecting line 30. A further connecting line 32 serves to trigger the electrical machine 22 via the control unit 26.

Starting of the engine 12 is effected as follows:

The electrical machine 22 is operated in the motor mode, with regulation being done via the control unit 26. By operating the electrical machine 22 in the motor mode, crankshaft 16 is set into rotary motion via the gear 20 and the driven shaft 18. The current crankshaft position is detected via the rotary angle sensor 24 and reported to the control unit 26. If the crankshaft 16 attains an angular position which corresponds to a previously defined starting position, then in one of the cylinders 14, which is selected as a starting cylinder as a function of the initial position, the injection of fuel and its subsequent ignition are brought about via the control unit 26. The electric motor drive of the crankshaft 16 via the electrical machine 22 is uninterrupted in the process. That is, with the onset of the starting operation, the crankshaft 16 is set, via the electrical machine 22, into rotary motion, which persists with the attainment of the defined starting position and the subsequent injection and ignition in the starting cylinder. During the injection and ignition and the subsequent combustion event in the starting cylinder, the crankshaft 16 accordingly has an rpm other than zero. With the ignition in the starting cylinder, a superposition of an electrical or mechanical torque, brought to bear via the electrical machine 22, on a combustion moment brought about by the combustion in the starting cylinder occurs. As a result, there is a rapid acceleration of the crankshaft 16, and—if present—with the attainment of the respective starting position by the pistons assigned to the respectively other cylinders 14, direct injection of fuel into the corresponding cylinders 14 and its subsequent ignition takes place, controlled via the control unit 26.

During the entire starting phase, the electrical machine 22 remains switched in the motor mode, so that a corresponding superposition of torque on the basis of the successive ignition of the individual cylinders 14 (combustion moments) on the torque brought to bear by electric motor occurs. The runup to speed of the engine 12 effected by the combustion moments in the individual cylinders 14 is supported by the electrical machine 22 operating as an electric motor. The control of injection and ignition coordinated by the control unit 26 leads to a superposition of electrically and thermodynamically generated torques and thus to a continuously accelerated course of motion of the crankshaft 16, which changes over seamlessly to a state in which the engine 12 is running on its own.

The triggering of the electrical machine 22 via the control unit 26 can be designed in such a way that in the vicinity of a cold start limit temperature, when the engine 12 is not yet at operating temperature, only an electrically generated torque is needed, which is slightly higher than the total of the frictional motions of the engine. This becomes possible since until the first starting position of the crankshaft 16 is reached, that is, up to the time when a piston of one of the cylinders 14 is in a favorable starting position, only a minimal angular rotation of the crankshaft 16 is necessary, and within the short time the crankshaft 16 has a relatively low rpm, at which no significant compression moments need to be generated yet in the other cylinders 14. The injection and ignition of a first cylinder 14, which is then the starting cylinder, virtually takes place at a relatively low rpm of the crankshaft 16. In accordance with the position of the crankshaft 16 when the engine 12 is at a stop, the cylinder 14 whose piston is the first to reach the favorable starting position via the electric motor rotation of the crankshaft 16, can act as the starting cylinder. A favorable angular position of the crankshaft 16 is for instance reached when the piston of the starting cylinder 14 is at an angular position markedly past top dead center, for instance 30 to 70°. One of the cylinders 14, whose piston is the first to reach the predeterminable starting position, in accordance with the outset position of the crankshaft 16, is selected via the control unit 26 as the starting cylinder.

After a preferred triggering, it may be provided that in accordance with the current position of the crankshaft 16, ascertained via the rotary angle sensor 24, at the instant of starting, a reverse rotation of the crankshaft 16 is effected by moving the piston of the selected cylinder 14 backward into the starting position, that is, into the position of 30 to 70°, for instance, after top dead center of the engine 12. This causes a compression in the starting cylinder, which in the ensuing direct injection and ignition of the fuel leads to a marked increase in the combustion moment of the starting combustion. As a result, the dynamics of the starting operation are markedly increased still further.

In summary, by means of the improved mixture preparation of the fuel associated with direct injection and the starting regimen of the engine 12 as explained, an acceleration of the crankshaft can already be reached before the first combustion. The further combustions following the starting combustion are then progressively improved, so that quick starting takes place even under cold starting limit conditions.

Further optimization of the starting operation can be attained by optimizing the valve control, for injection of the fuel into the cylinders 14, during the starting event to the combustion moments to be brought to bear during the start. This can be done for instance by means of an electromagnetic valve triggering via the control unit 26.

In summary, especially since no additional mechanical wear parts are needed, a very high number of starting cycles, for instance more than 500,000, can be attained for the engine 12. Furthermore, there is no need for prepositioning or for a targeted runout of the crankshaft 16 to a certain position, which take time and are complicated to regulate. With the desired start, the crankshaft 16 is rotated via the electrical machine 22, and the favorable starting position is picked up via the rotary angle transducer 24, which furnishes a corresponding report to the control unit 26, which thereupon controls the injection and ignition. In a further simplification, maintaining a starting position of the crankshaft 16 at a precise angle at which the injection and ignition in the starting cylinder 14 take place can be omitted, so that the crankshaft 16 is rotated by motor up to speed slowly, and the cylinders 14 are ignited in succession, each for the first time, in a previously fixed order. Once again, the torque brought to bear on the crankshaft via the combustion moments is supported by the electrical machine 22. By the rotation of the crankshaft 16 during the first combustion event, the first torque from the combustion is higher than in a known in turn direct starting in which the crankshaft 16 is started from a standstill. The torque of the electrical machine 22 and the combustion moment of the first combustion support one another, so that the second combustion already assures a pronounced compression, improved thermodynamic conditions, and thus the prerequisite for an independent runup to operating speed of the engine 12.

Once the engine 12 has successfully run up to operating speed, the electrical machine 22 can be switched over from the motor mode to the generator mode at a selectable rpm of the crankshaft 16 and the with the driven shaft 18. Switching the electrical machine 22 back from the generator to the motor mode can also be done as a function of rpm. Depending on the selectable switchover rpm, a generator mode of the electrical machine 22 is possible at relatively low rpm of the crankshaft 16, without the risk of an abortive start, since the engine 12 at relatively low rpm can easily be intercepted by switching the electrical machine 22 over.

It should be mentioned that when the engine 12 is turned off, a favorable position of the starting cylinder 14 is attained by suitable provisions.

What is claimed is:

1. A drive assembly of a motor vehicle, having a multicylinder internal combustion engine and an electrical machine capable of driving a crankshaft of the engine, wherein the electrical machine can be switched to motor and generator modes, and having an electronic control unit for controlling direct injection and ignition of the engine, wherein at the start of the engine the crankshaft can be put in a predeterminable starting position via the electrical machine switched for motor operation, and upon attaining the starting position of the crankshaft, fuel is injected into a starting cylinder and ignition is effected, characterized in that the starting cylinder is the cylinder, whose piston can be brought into the starting position over the shortest crankshaft rotation path, and a torque is exerted on the crankshaft by the electrical machine during the entire starting operation until the engine reaches running speed.

2. The drive assembly of claim 1, characterized in that to initiate the starting operation, the current position of the crankshaft (16) can be ascertained, and independently of the direction of rotation the crankshaft (16) is brought into the starting position over the shortest path from the current crankshaft position and then is rotated onward in the correct rotational direction.

3. The drive assembly of claim 1, characterized in that the starting position of the crankshaft (16) is determined by the crank angle position associated with a selected starting cylinder (14).

4. The drive assembly of claim 3, characterized in that the angle position of the crankshaft (16) is located in an angular range after top dead center and markedly before bottom dead center of the engine (12).

5. The drive assembly of claim 1, characterized in that the piston of the starting cylinder (14) can be brought into the starting position by rotating the crankshaft (16) in reverse.

6. The drive assembly of claim 1, characterized in that the electrically generated torque of the electrical machine (22) is only slightly higher than the sum of frictional moments of the engine (12).

7. The drive assembly of claim 1, characterized in that the starting cylinder (14) is selected in such a way that the highest possible compression is obtained by the positioning in the starting position before ignition.

8. The drive assembly of claim 1, characterized in that when the engine (12) is turned off, a favorable position of the starting cylinder (14) is attained by suitable provisions.

* * * * *